US011752368B2

(12) United States Patent
Barbeau et al.

(10) Patent No.: US 11,752,368 B2
(45) **Date of Patent: *Sep. 12, 2023**

(54) FIREFIGHTER PANTS HAVING KNEE PADS

(71) Applicant: INNOTEX INC., Richmond (CA)

(72) Inventors: Claude Barbeau, Richmond (CA); Danny Roy, Richmond (CA)

(73) Assignee: INNOTEX INC. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/542,683

(22) Filed: Dec. 6, 2021

(65) Prior Publication Data

US 2022/0088419 A1 Mar. 24, 2022

Related U.S. Application Data

(63) Continuation of application No. 16/839,262, filed on Apr. 3, 2020, now Pat. No. 11,219,784.

(60) Provisional application No. 62/829,325, filed on Apr. 4, 2019.

(51) Int. Cl.

| | |
|---|---|
| ***A41D 31/08*** | (2019.01) |
| ***A62B 17/00*** | (2006.01) |
| ***A41D 13/06*** | (2006.01) |
| *A41D 13/05* | (2006.01) |

(52) U.S. Cl.

CPC ..... *A62B 17/003* (2013.01); *A41D 13/065* (2013.01); *A41D 31/085* (2019.02)

(58) Field of Classification Search

CPC .. A62B 17/003; A41D 31/085; A41D 13/065; A41D 31/08

See application file for complete search history.

(56) References Cited

U.S. PATENT DOCUMENTS

| | | | | | |
|---|---|---|---|---|---|
| 4,561,123 | A * | 12/1985 | Hull | A41D 13/065 | 2/16 |
| 6,553,573 | B1 * | 4/2003 | Brown | A41D 13/08 | 2/24 |
| 6,988,281 | B1 * | 1/2006 | Jerome | A41D 13/0568 | 2/24 |
| 7,114,188 | B1 * | 10/2006 | Teigen | A41D 13/0568 | 2/24 |
| 7,380,283 | B1 * | 6/2008 | Dumont | A41D 13/0562 | 2/23 |
| 7,415,733 | B2 * | 8/2008 | Rampersad | A41D 13/0556 | 2/23 |
| 7,490,360 | B2 * | 2/2009 | Meadows | A41D 13/0556 | 2/23 |

(Continued)

OTHER PUBLICATIONS

Polyaramid Polyparaphenylene Terephthalaminde (Kevlar / Twaron)—Properties and Applications, https://www.azom.com/article.aspx?ArticleID=1992; May 19, 2003. Accessed Jun. 7, 2021. (Year: 2003).

*Primary Examiner* — Robert H Muromoto, Jr.
(74) *Attorney, Agent, or Firm* — Dilworth IP, LLC

(57) ABSTRACT

Firefighter protective pants including an inner liner, an outer shell and two pant legs. The outer shell is made of a flame-resistant material and extends over at least a portion of the inner liner. Each of the two pant legs includes a knee sleeve affixed to the inner liner at a knee height inside the corresponding pant leg and a knee pad held on the knee sleeve and extending across a front knee portion of the corresponding pants leg.

19 Claims, 20 Drawing Sheets

(56) References Cited

U.S. PATENT DOCUMENTS

| | | | | |
|---|---|---|---|---|
| 7,913,322 | B2 * | 3/2011 | Aldridge | A62B 17/003 2/81 |
| 7,937,769 | B2 | 5/2011 | Richards | |
| 7,945,968 | B2 | 5/2011 | Johnson | |
| 8,108,945 | B2 | 2/2012 | Sanchez | |
| 8,141,169 | B2 | 3/2012 | Saranga | |
| 8,166,570 | B2 | 5/2012 | Matuszak et al. | |
| 8,407,812 | B2 | 4/2013 | Godshaw et al. | |
| 9,717,292 | B2 | 8/2017 | Johnson | |
| 9,867,408 | B2 | 1/2018 | Pratson et al. | |
| 10,143,863 | B2 * | 12/2018 | Provencal | A41D 27/202 |
| 10,245,454 | B2 * | 4/2019 | Barbeau | A41D 31/085 |
| 11,219,784 | B2 * | 1/2022 | Barbeau | A41D 13/065 |
| 2006/0260020 | A1 * | 11/2006 | Seguin | A62B 17/003 2/93 |
| 2006/0277651 | A1 * | 12/2006 | Razzaghi | A41D 13/0002 2/81 |

* cited by examiner

FIREFIGHTER PANTS HAVING KNEE PADS

TECHNICAL FIELD

The technical field generally relates to protective garments for firefighters and more particularly concerns firefighter pants and knee pads for such pants.

BACKGROUND

During their firefighting activities, firefighters sometimes need to kneel or crawl. In the long term, some firefighters may develop knee injuries. Some firefighter pants in the prior art are provided with cushions in the knee portion. However, such cushions are known to be uncomfortable to use or wear. Furthermore, conventional firefighter pants may be hard to push over the boot shaft, which may increase the time required to don or doff them.

Referring to FIG. 1 (PRIOR ART), there is illustrated an example of firefighter protective pants such according to prior art. Such pants may include padding provided under the form of pads or cushions. The pads are typically affixed to the outer shell or an outside portion of the outer shell. The firefighter protective pants of prior art can be at least partially covered by polymer reinforcement to provide mechanical reinforcement to the pads in the knee region.

There is a need in the industry for firefighter pants that alleviate at least in part the deficiencies of conventional firefighter garments and pants and seeks to solve problems and drawbacks of the prior art.

SUMMARY

Garments for firefighters and more particularly firefighter protective pants having knee pads are described herein.

In accordance with one aspect, there are provided firefighter protective pants, including:

an inner liner;

an outer shell made of a flame-resistant material, the outer shell extending over at least a portion of the inner liner; and two pant legs, each of said two pant legs including:

a knee sleeve affixed to the inner liner at a knee height inside the corresponding pant leg; and a knee pad held on the knee sleeve and extending across at least one of a front knee portion and lateral portions of said corresponding pants leg.

In some embodiments, the knee pad is made from closed-cell foam.

In some embodiments, the knee pad includes perforations therein.

In some embodiments, each perforation has a diameter of about ⅛ inch.

In some embodiments, the perforations are evenly distributed across a surface of the knee pad.

In some embodiments, the firefighter protective pants further include an abrasion-resistant mesh fabric covering the knee pad.

In some embodiments, the abrasion-resistant mesh fabric includes poly-paraphenylene terephthalamide.

In some embodiments, the abrasion-resistant mesh fabric includes a para-aramid material.

In some embodiments, the knee sleeve includes an innermost surface and at least a portion of the innermost surface is made of a meta-aramid material.

In some embodiments, said at least portion of the innermost surface extends across the front knee portion of said corresponding pants leg.

In some embodiments, the knee pad is permanently attached to the knee sleeve.

In some embodiments, the knee sleeve includes a top portion and a bottom portion, the firefighter protective pants further including at least one pulling tab, each pulling tab being affixed near or at the top portion of the knee sleeve and extending away from the knee sleeve.

In some embodiments, the knee sleeve is funneled from the top portion towards the bottom portion.

In some embodiments, said at least one pulling tab includes a left pulling tab and a right pulling tab provided in each pant leg, the left pulling tab being provided on a left lateral portion of the corresponding firefighter's knee and the right pulling tab being provided on a right lateral portion of the corresponding firefighter's knee.

In some embodiments, said at least one pulling tab further includes a rear pulling tab provided in each pant leg, the rear pulling tab being provided on a back portion of the corresponding firefighter's knee.

In some embodiments, the firefighter protective pants further include:

an attachment tab permanently affixed to the knee sleeve; and a support band having two extremities permanently affixed to the inner liner and a middle portion detached from the inner liner, wherein the middle portion of the support band is configured to receive a segment of the attachment tab therethrough to engage the attachment tab with the support band, thereby affixing the attachment tab to the inner liner.

In some embodiments, the attachment tab includes:

a base portion, the base portion including a first fastener; and a foldable portion, the foldable portion including a plurality of vertically spaced adjustment fasteners, the foldable portion being configured to be folded towards the base portion after insertion of the attachment tab in the middle portion of the support band, wherein the first fastener is engageable with any of the plurality of vertically spaced adjustment fasteners to set a vertical position of the knee sleeve inside the corresponding pant leg.

In some embodiments, the knee sleeve is stretchable.

In some embodiments, the knee sleeve includes a stretchable band.

In some embodiments, the stretchable band includes a blend of an aramid material and a fire-resistant viscose material.

In some embodiments, the knee sleeve is a tubular piece of material.

In some embodiments, the tubular piece of material is shaped and sized to fit snuggly around the firefighter's knee when the firefighter protective pants are worn by the firefighter.

In some embodiments, the inner liner is one of a moisture barrier or a thermal barrier.

In some embodiments, the knee pad has a length of about 10 inches and a width of about 7 inches.

In accordance with another aspect, there are provided firefighter protective pants. The firefighter protective pants have two pants legs and include an inner liner; an outer shell made of a flame-resistant material, the outer shell extending over at least a portion of the inner liner. Each of said two pants legs includes a knee support configured to receive a portion of a respective firefighter's leg therethrough and being affixed to the inner liner at a knee height inside the corresponding pants leg and a knee pad held by the knee support and extending across a knee portion of said corresponding pants leg.

In accordance with some implementations, firefighter protective pants according to the following description may provide knee protection that is stable on the knee, may provide a satisfactory knee coverage (ideally full knee coverage), while being at the same time light, comfortable and easy to don and doff.

Other features and advantages of the present description will become more apparent upon reading of the following non-restrictive description of specific embodiments thereof, given by way of example only with reference to the accompanying drawings.

DETAILED DESCRIPTION

Figure 1:
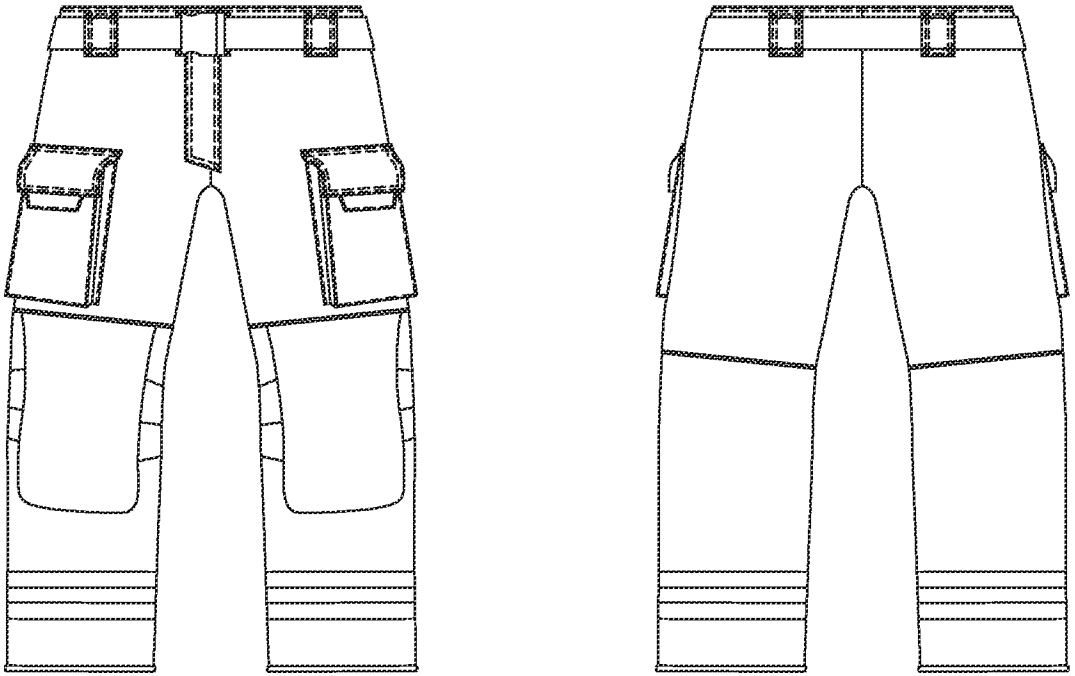
FIG. 1 (PRIOR ART)
FIG. 1 illustrates firefighter protective pants of prior art.

In the following description, similar features in the drawings have been given similar reference numerals, and, to not unduly encumber the figures, some elements may not be indicated on some figures if they were already identified in one or more preceding figures. It should also be understood herein that the elements of the drawings are not necessarily depicted to scale, since emphasis is placed upon clearly illustrating the elements and structures of the present embodiments.

The terms "a", "an" and "one" are defined herein to mean "at least one", that is, these terms do not exclude a plural number of elements, unless stated otherwise. It should also be noted that terms such as "substantially", "generally" and "about", that modify a value, condition or characteristic of a feature of an exemplary embodiment, should be understood to mean that the value, condition or characteristic is defined within tolerances that are acceptable for the proper operation of this exemplary embodiment for its intended application.

It will be appreciated that positional descriptors indicating the position or orientation of one element with respect to another element are used herein for ease and clarity of description and should, unless otherwise indicated, be taken in the context of the figures and should not be considered limiting. It will be understood that spatially relative terms (e.g., "frontward" and "rearward", "front", "lateral" and "rear", "left" and "right", "top" and "bottom" and "frontwardly", "rearwardly" and "laterally") are intended to encompass different positions and orientations in use or operation of the present embodiments, in addition to the positions and orientations exemplified in the figures.

In accordance with one aspect, there are provided firefighter pants having knee pads supported in knee sleeves.

It has been found that in order to cover a sufficient portion of the knee, the pads of prior art are generally relatively large or at least much larger than the knee to be covered. The pads from prior art are generally affixed to the outer shell, and so are not particularly close or adjusted to the body of the firefighter in the knee portion. The pads can therefore move or be twisted during the normal activities of the firefighters, thereby potentially exposing portion of the knee(s) or the entire knee(s) of the firefighter. As a result, firefighters can have their knee touching the ground outside the padded area of the knee portions, i.e., their knees may be unprotected or uncovered which may in turn defeat the purpose of providing padding in the knee portion. The existing firefighter protective pants are not known to be particularly comfortable in the knee region of the firefighter's body.

As will be better understood from the description below, the knee sleeves described herein can provide a better and/or more stable alignment of a knee pad on a firefighter's knee.

Figure 2C:
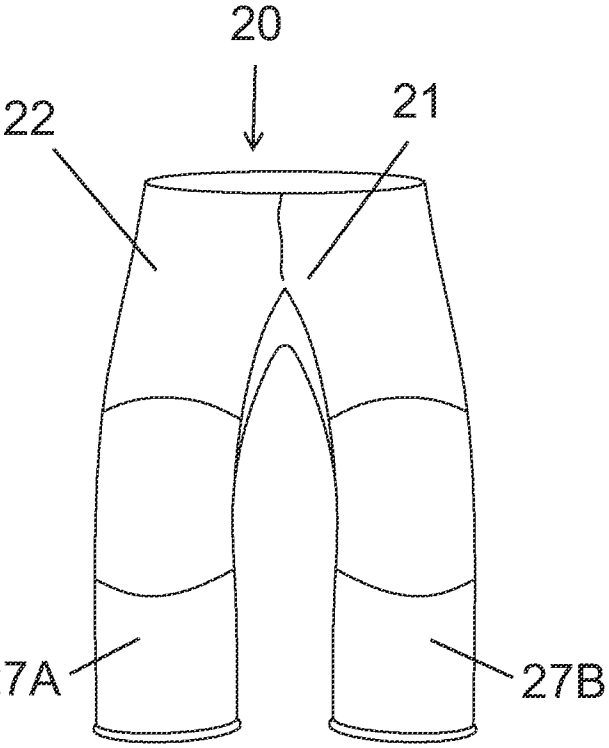
FIGS. 2A-C show different representations of an outer shell of firefighter protective pants, in accordance with one embodiment.
Figure 2B:
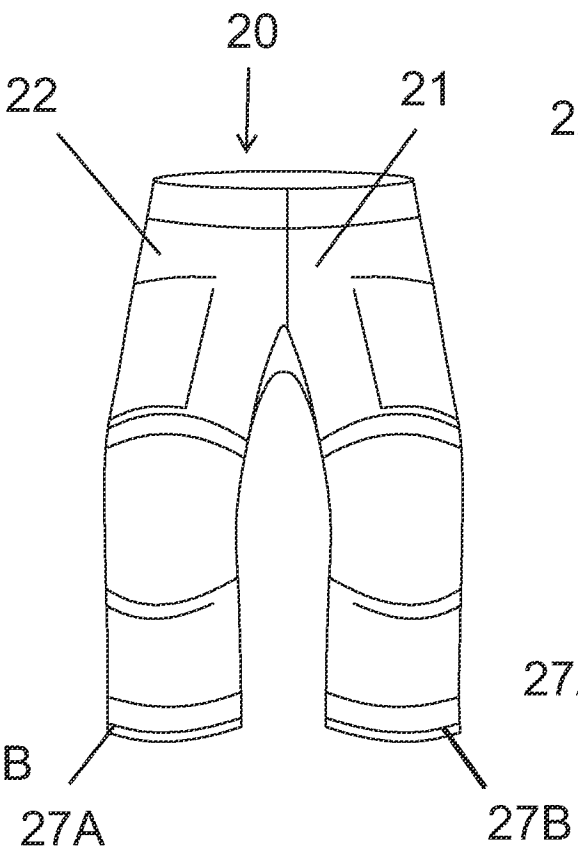
Figure 2A:
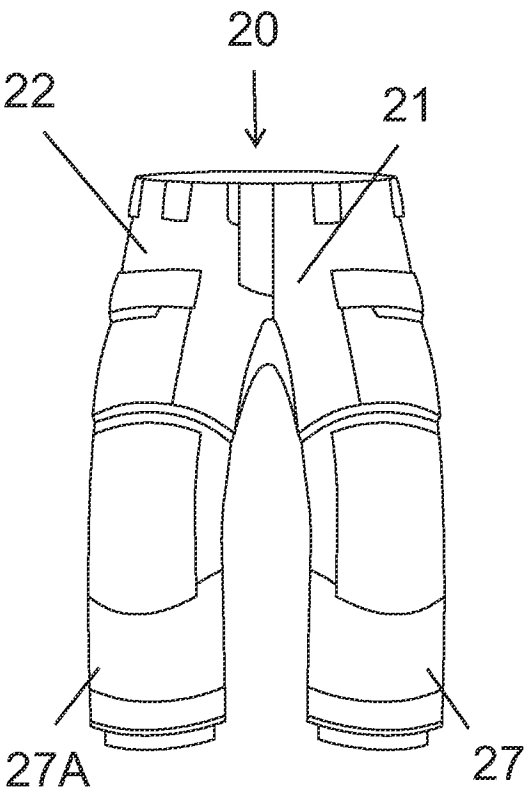

With reference to FIGS. 2A-C, there are illustrated firefighter pants 20 including a pant outer protective shell 22 (referred to as the "outer shell 22"). The outer shell 22 is made of a fire-resistant material. Such a fire-resistant material can include but is not limited to a fabric of aramid fibers. A common fire-resistant material is sold under the trademark NOMEX. The outer shell 22 is mechanically resistant, so as to provide the firefighter protective pants with sufficient resistance to abrasion and/or puncture for firefighting activities. FIGS. 2A-C illustrate different embodiments of the outer shell 22 of the firefighter protective pants 20. The outer shell 22 may include one or more pockets. In some embodiments, the outer shell 22 can be shaped or preformed in the knee region, i.e., the firefighter protective pants 20 can be provided with a curve in the knee region to better conform with the natural shape of a firefighter's leg.

As any other pants, and still referring to FIGS. 2A-C, the firefighter protective pants 20 according to the present disclosure include a pelvic region 21 and two pants legs 27A,B aligned with the corresponding firefighter's pelvis and firefighters' legs when the firefighter pants 20 are worn.

Figure 3A:
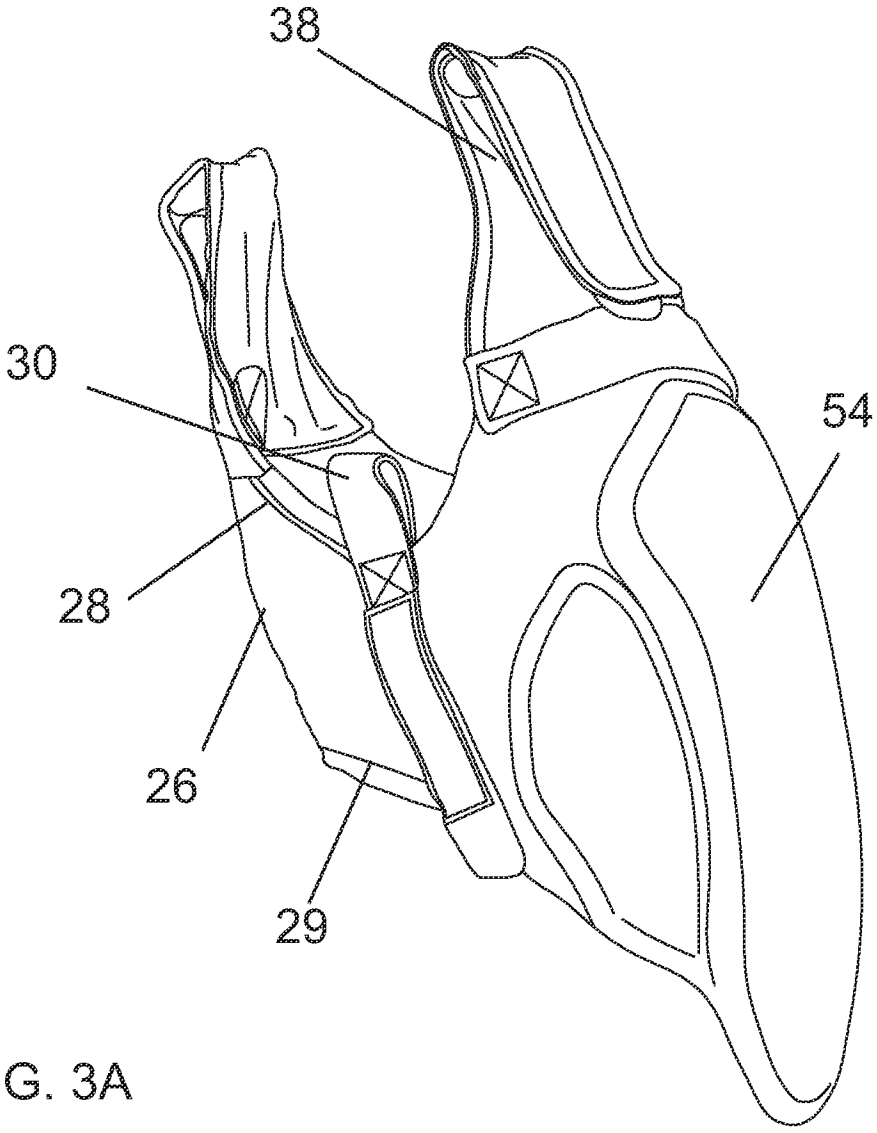
FIGS. 3A-B illustrate a knee pad held on a knee sleeve and an exploded view of the knee pad and the knee sleeve, in accordance with one embodiment.
Figure 3B:
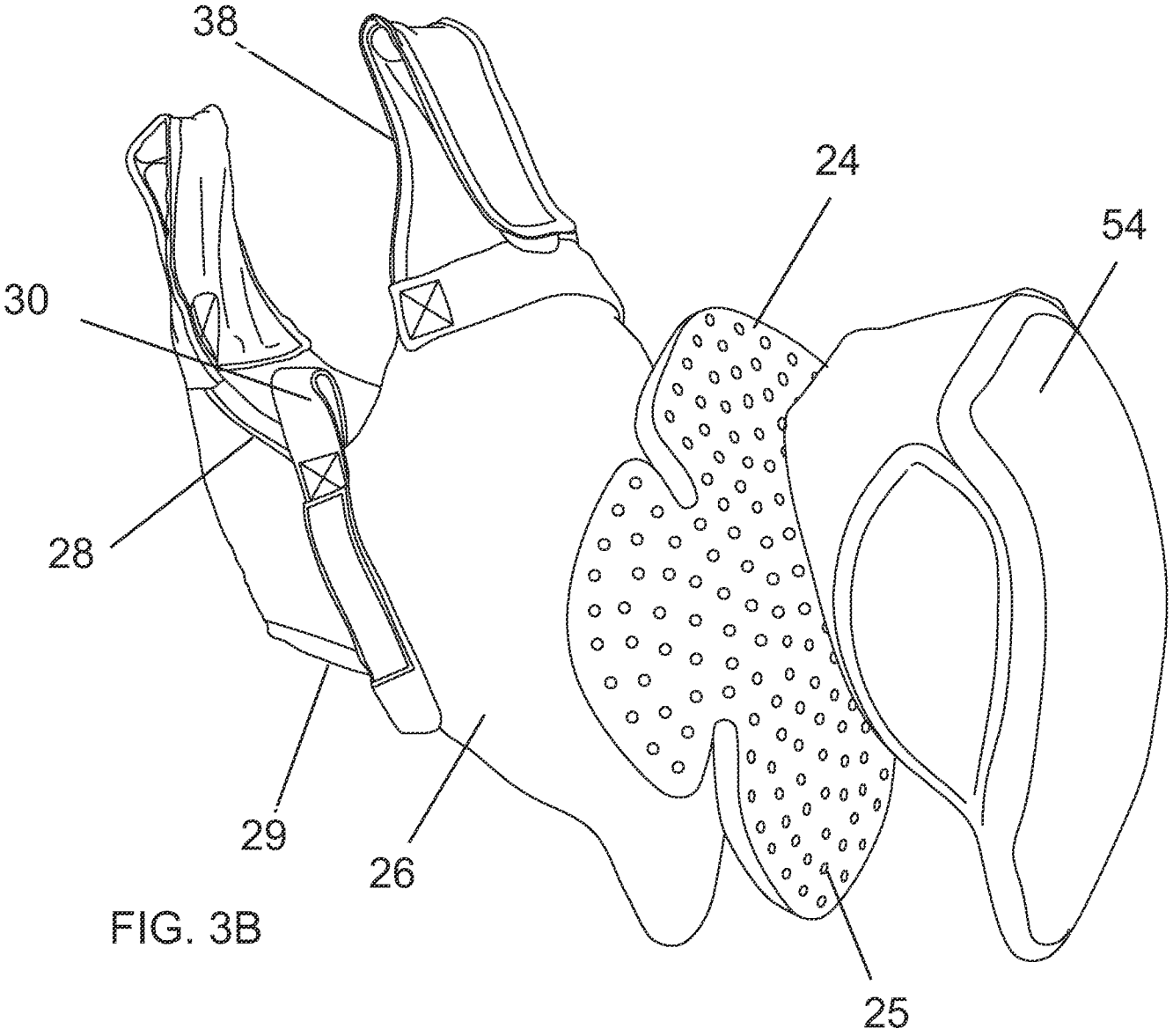
Figures 4A, 4B:
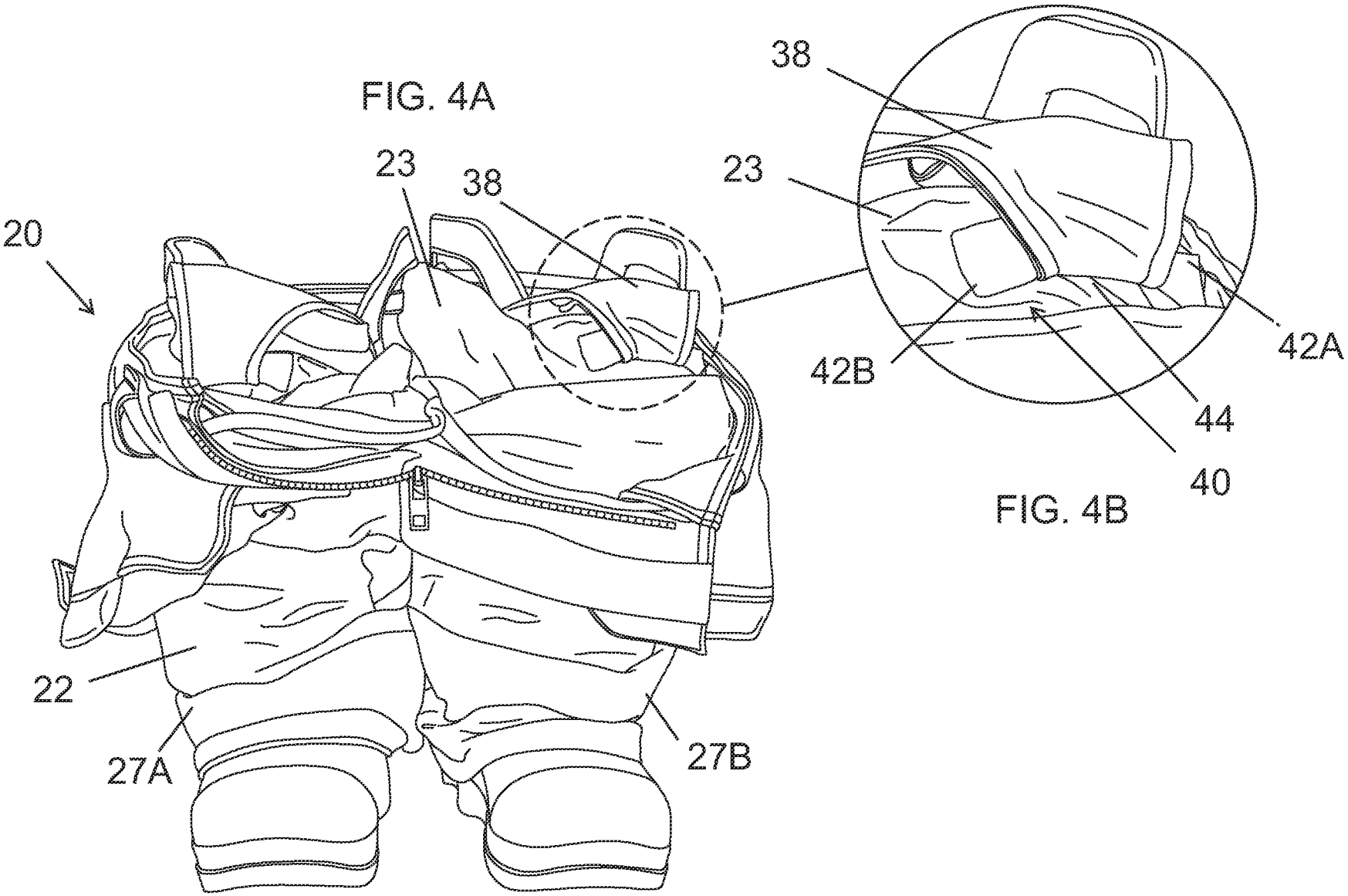
FIGS. 4A-B illustrate the knee sleeve of FIG. 3A, the knee sleeve being affixed to an inner liner at a knee height inside pant legs of firefighter protective pants, in accordance with one embodiment.

Now turning to FIGS. 4A-B, the firefighter pants 20 also include a pant inner liner 23 (referred to as the "inner liner 23"). As illustrated, the outer shell 22 extends over at least a portion of the inner liner 23. The inner liner 23 may include one or more layers and is in contact with the body of the firefighter when the firefighter protective pants 20 are worn. The inner liner 23 typically includes a moisture barrier, which may be made, for example and without being limitative of expanded polytetrafluoroethylene (ePTFE) and/or polyurethane (PU) laminated to a woven or non-woven aramid substrate. The inner liner 23 also typically includes a thermal barrier including a face cloth quilted to an aramid substrate. The inner liner 23 is typically separable from the outer shell 22 to facilitate inspection, maintenance, washing and care of the inner liner 23 and the outer shell 22. In some embodiments, the inner liner 23 is one of a moisture barrier or a thermal barrier. With reference to FIGS. 2A-B, 3A-B and 4A-B, each of the two pant legs 27A-B includes a knee sleeve 26 (sometimes referred to as the "knee support") affixed to the inner liner 23 at a knee height inside the corresponding pant leg 27A or 27B. Each of the two pant legs 27A-B also includes a knee pad 24 held on the knee sleeve 26 and extending across at least one of a front knee portion and lateral knee portions of the corresponding pant leg 27A or 27B.

The knee pad 24 will now be described in greater detail.

In some embodiments, such as the one illustrated in FIG. 3B, the knee pad 24 is made from closed-cell foam. In some implementations, the knee pad 24 may remain substantially dry when the firefighter pants 20 are worn by the firefighter during firefighting activities. In other embodiments, the knee pad 24 may be made from any other materials having characteristics similar to the one of closed-cell foam. For example, and without being limitative, the material may be lightweight, flexible and/or energy-absorbing.

In some embodiments, and as illustrated in FIG. 3B, the knee pad 24 may comprise perforations 25 therein. In some embodiments, each perforation 25 may have a diameter of about ⅛" inch. In some embodiments, the perforations 25 are evenly distributed across a surface in the knee pad 24, i.e., the distance between each perforation is substantially the same, such that the perforations 25 are evenly spaced through the entire surface of the knee pad 24. This feature may allow air circulation.

In terms of dimensions, in some embodiments, the knee pad 24 has a length of about 10 inches and a width of about 7 inches. In most embodiments, the knee pad 24 should cover the entire knee (i.e., front and lateral portions of the knee). Apart from the dimensions, another aspect of the knee pad 24 to consider is the shape of the knee pad 24. In some embodiments, the extremities or the tips of the knee pads may be such that they provide more flexibility to the material forming the knee pad 24 and prevent material accumulation when the knee pad 24 conforms to the body once the firefighter protective pants 20 are worn by the firefighter. For example, and without being limitative, the extremities of the knee pad 24 may allow the knee pad 24 to fold more easily on the sides of the knee pad 24 to provide lateral protection. In some embodiments, different sections (i.e., areas) of the knee pad 24 may be provided with an additional layer of foam, which results in a greater thickness in some region(s) of the knee pad 24. Such an increased thickness in some region(s) of the knee pad 24 may provide a better protection in some areas of the knee of the firefighter, for instance areas that are more susceptible to receive an impact or come into contact with uneven surfaces when the firefighter kneels or crawls.

The combination of the material forming the knee pad 24 and the perforations 25 may allow adequate ventilation or air circulation in the knee region of the pant legs 27A,B, providing the thermal protection and compressive protection required during firefighting activities.

Figure 6B:
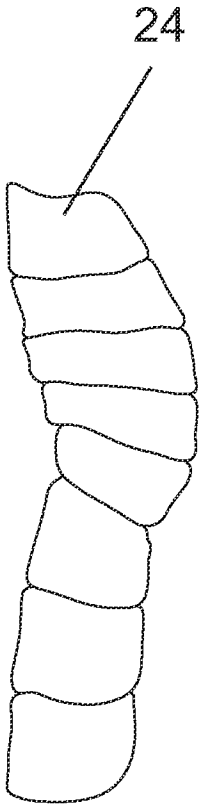
FIGS. 6A-B illustrate an embodiment of the knee pad.
Figure 6A:
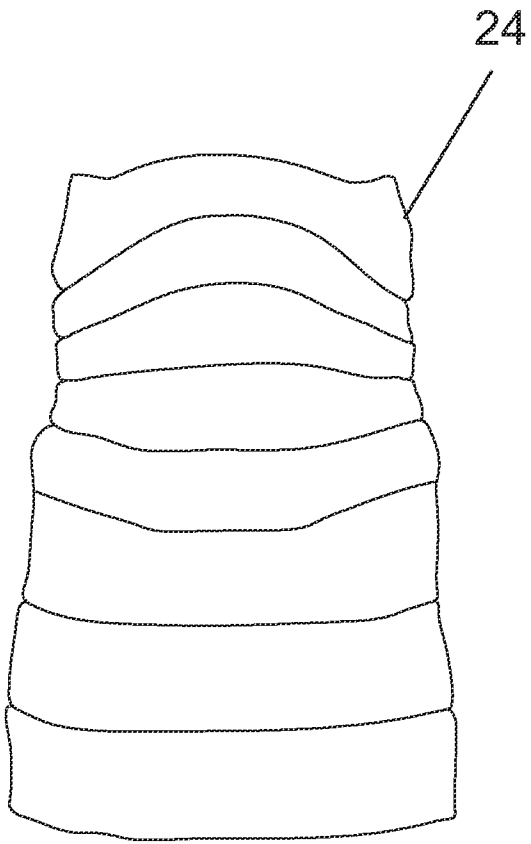

A non-limitative embodiment of the knee pad 24 is illustrated in FIGS. 6A-B. As shown, the knee pads 24 can be sized and configured to conform to the firefighter's knee when the firefighter protective pants 20 are worn by the firefighter. In the illustrated embodiment, the knee pads 24 includes a plurality of adjacent and contiguous bands. Each band is affixed to one or more subsequent or neighbour bands along a portion of its perimeter. For example, and without being limitative, two neighbour bands can be seamed together along a horizontal portion of their perimeter. In some embodiments, the bands can extend along a substantially horizontal direction (i.e., along an axis perpendicular to the longitudinal axis of the firefighter's leg), when observed from a front view perspective. One or more bands can have a curve provided therein or be shaped to better conform to the firefighter's knee (i.e. "preformed"). As better seen in the side view of the knee pad 24 shown in FIG. 6B, the knee pads 24 can also have a curve provided therein, the curve generally extending between a top section and a bottom section of the knee pad 24 to accommodate motion and flexing of the firefighter's knee during his/her normal activities. Still referring to the side view of the knee pad 24, one would note that one or more bands can protrude or project from an outer surface the knee pads 24 near or at the middle section of the knee pads 24. In some embodiments, the outer surface of the knee pads 24 can at least partially be accordion-shaped, thereby enabling relative movement of each band one with respect to another when the knee is bent or unbent. This accordion-shaped outer surface could further be useful to provide flexibility to the knee pads 24 and accommodate different firefighter's knee sizes. In some embodiments, the knee pads 24 can be made from a fire-resistant fabric or material(s), such as the ones commercialised by Kobleder GmbH.

The knee sleeve 26 will now be described in greater detail.

In the illustrated embodiments of FIGS. 3A-B, the knee sleeve 26 is sized and configured to receive a portion of a respective firefighter's leg therethrough. More particularly, when donning the firefighter protective pants 20, the firefighter can insert his foot through the knee sleeve 26. In some embodiments, the knee sleeve 26 is a tubular piece of material or a piece of fabric having a tubular section. The tubular piece of material may be shaped and sized to fit snuggly around the firefighter's knee when the firefighter protective pants 20 are worn by the firefighter and apply a mild compression to the knees of the firefighter when the firefighter protective pants 20 are worn. The knee sleeve 26 is sized and positioned to surround the firefighter's knee when the firefighter protective pants 20 are worn by the firefighter.

It is to be noted that since the firefighter protective pants 20 include two pants legs, the firefighter protective pants 20 include a first knee sleeve and a second knee sleeve, each one of the first and second knee sleeves being configured to receive a portion of a respective firefighter's leg therethrough. The first and second knee sleeves are affixed to the inner liner at a knee height inside a corresponding one of the two pant legs of the firefighter protective pants 20 (i.e., the left or right pants legs). Correspondingly, the firefighter protective pants 20 also include a first knee pad and a second knee pad, each one of the first and second knee pads being held by a respective one of the first and second knee sleeves such that the first and second knee pads are each extending over a respective knee portion of the firefighter protective pants 20. As it has been previously mentioned, the knee sleeve 26 is affixed to the innermost layer of the inner liner 23, i.e., the layer that is the closest to the firefighter's body.

Figure 5:
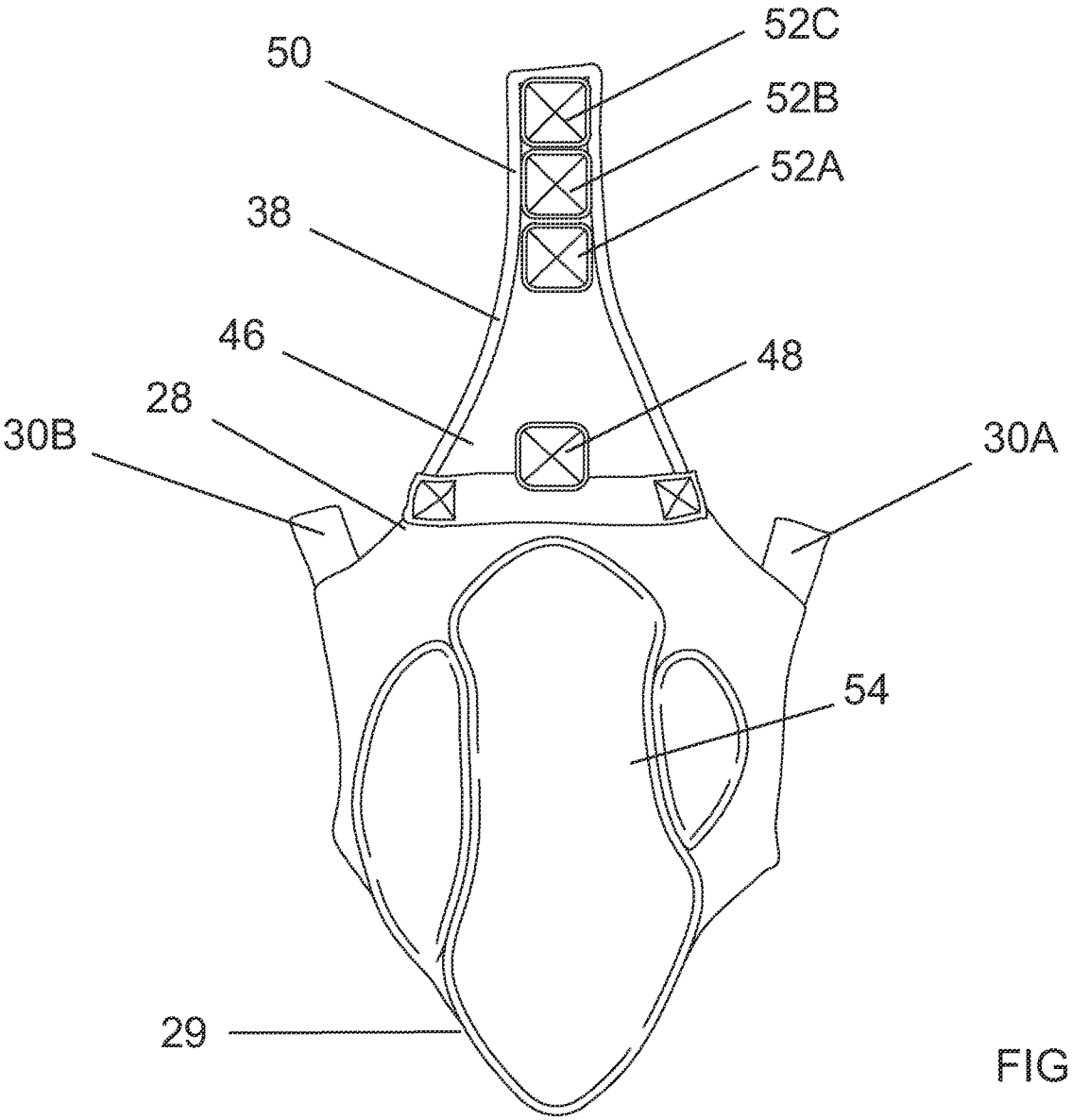
FIG. 5 is a front view of the knee pad held on the knee sleeve of FIG. 3A.

With reference to FIGS. 3A-B and FIG. 5, the knee sleeve 26 has a top portion 28 and a bottom portion 29. It will be readily understood that the expressions "top" and "bottom" are used in this context to orient the knee sleeve 26 with respect to the vertical when the firefighter wearing the pants is in a standing position. The top portion 28 of the knee sleeve 26 corresponds to the portion through which the firefighter inserts his leg first when donning the firefighter protective pants 20. The knee sleeve 26 may be provided with at least one pulling tab 30 (sometimes referred to as "handles"). As illustrated, each pulling tab 30 is affixed near or at the top portion 28 of the knee sleeve 26 and extends away from the knee sleeve 26. In some implementations, the knee sleeve 26 is provided with a left pulling tab 30A and a right pulling tab 30B, as illustrated in FIG. 5. The left pulling tab 30A is provided on a left lateral portion of the corresponding firefighter's knee and the right pulling tab 30B is provided on a right lateral portion of the corresponding firefighter's knee. In some embodiments, the knee sleeve 26 may also be provided with a rear pulling tab provided in each pant leg, the rear pulling tab being provided on a back portion of the corresponding firefighter's knee. More particularly, the pulling tabs 30 are positioned to remain accessible to the firefighter when donning the firefighter pants 20. The positioning of the pulling tabs 30 to facilitate donning of the firefighter protective pants 20, and more specifically, the alignment of the knee pad 24 and the knee sleeve 26 with the knees of the firefighters. The pulling tabs 30 can be embodied by an elastic strap or a piece of material extending away from the top portion 28 of the knee sleeve 26. The pulling tabs 30 should exhibit sufficient mechanical resistance to tolerate a pulling force exerted by the firefighter when adjusting the knee sleeve 26.

Figure 8B:
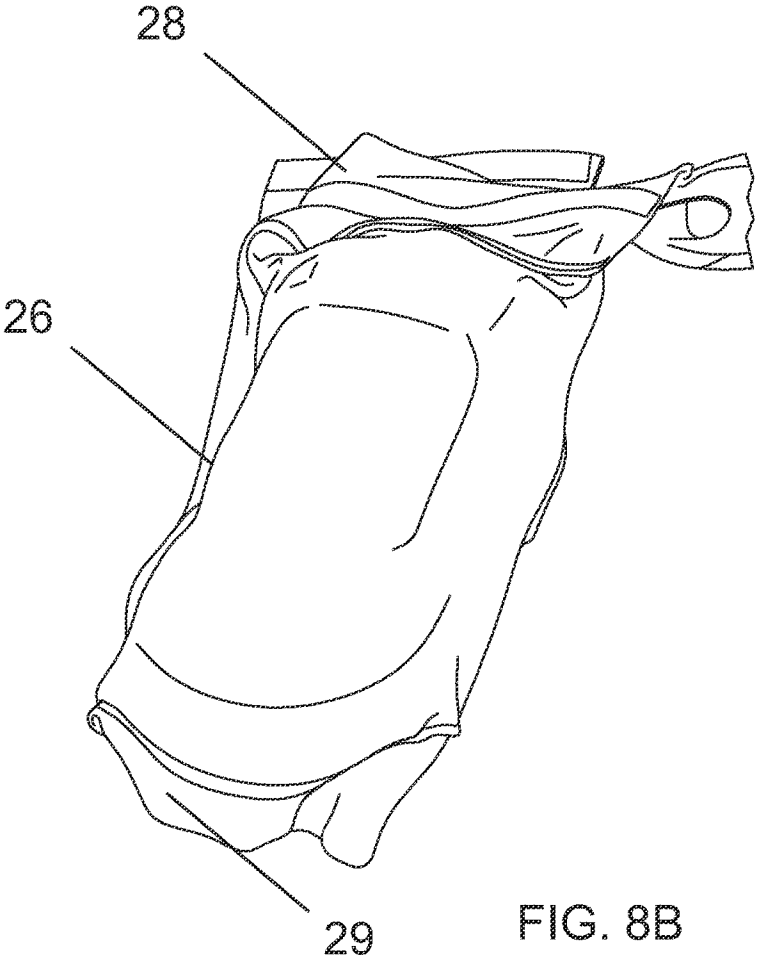
FIGS. 8A-D illustrate an embodiment of the knee pad and the knee sleeve.
Figure 8A:
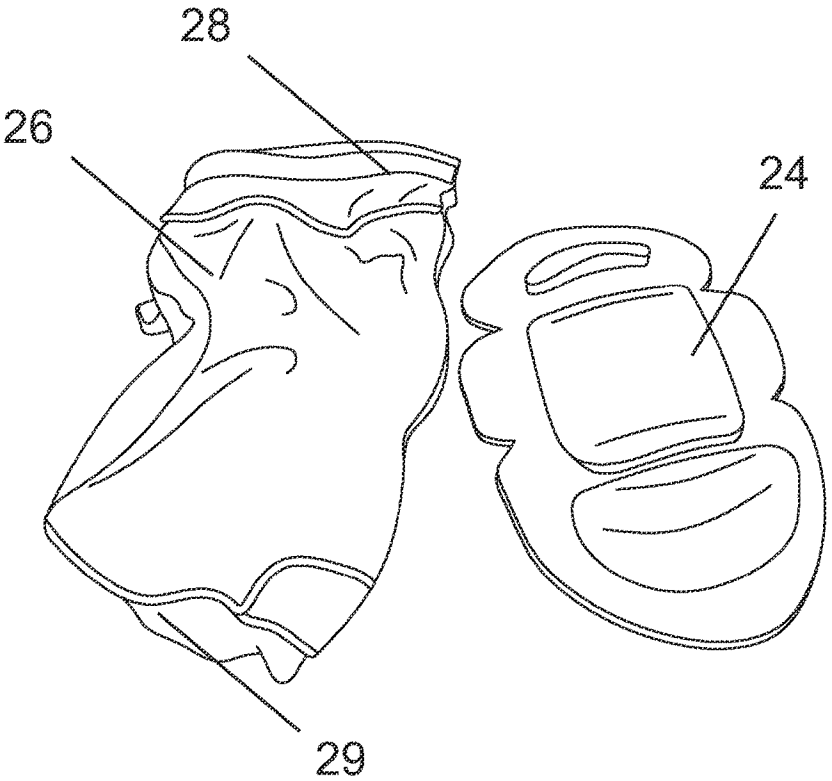
Figure 8D:
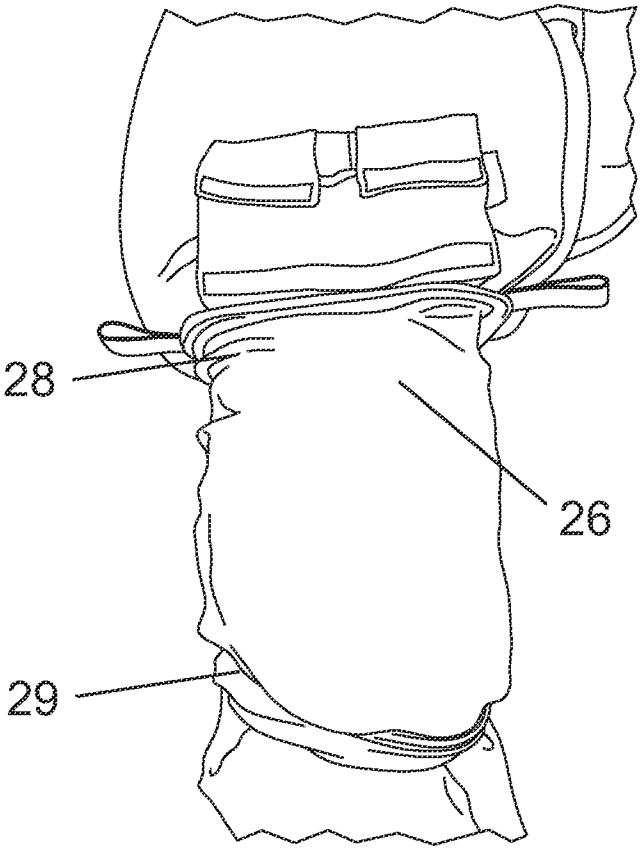
Figure 8C:
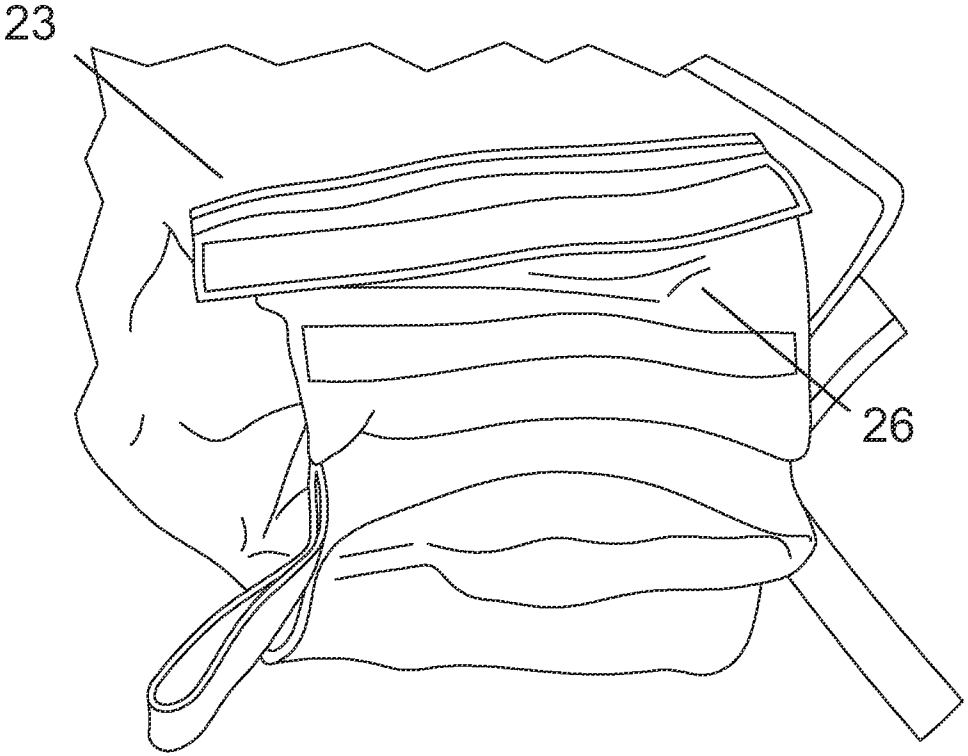

In some embodiments and with reference to FIGS. 8C-D, which respectively illustrate a pants leg of the firefighter pants and the same pants leg being provided inside out, the top portion 28 of the knee sleeve 26 can be seamed or attached to the inner liner. As illustrated, the knee sleeve 26 is affixed to the inner liner at the knee height, inside a corresponding one of the pants legs of the firefighter protective pants 20. In some embodiments, the top portion 28 is permanently attached to the inner liner. The top portion 28 of the knee sleeve 26 can be affixed to the inner liner 23 along an entirety or only a portion of its periphery. While the top portion 28 is affixed to the inner liner, the bottom portion 29 of the knee sleeve can remain free, i.e., unattached to the inner liner. Alternatively, the bottom portion 29 could also be affixed to the inner liner.

In some embodiments, the knee sleeve 26 may be funneled from the top portion 28 towards the bottom portion 29. In FIGS. 9C-D, the diameter of the pants leg of the inner liner 23 may be larger near the top portion 28 of the knee sleeve 26 than the bottom portion 29. Such a funnel portion may provide a mild compression in the knee region, thereby allowing maintaining the knee pad 24 in position (i.e., aligned with the knee).

Now turning to FIGS. 3A-B, 4A-B and 5, the firefighter protective pants 20 may include an attachment tab 38 permanently affixed to the knee sleeve 26 (FIG. 5). In some embodiments, the attachment tab 38 is integral, i.e., forms a single piece of material with the knee sleeve 26. The firefighter protective pants may also include a support band 40 having two extremities 42A,B permanently affixed to the inner liner 23 and a middle portion 44 detached from the inner liner 23 (FIGS. 4A-B). The middle portion 44 of the support band 40 is configured to receive a segment of the attachment tab 38 therethrough to engage the attachment tab 38 with the support band 40, thereby affixing the attachment tab 38 to the inner liner 23.

With reference to FIG. 5, in some embodiments, the attachment tab 38 includes a base portion 46. The base portion includes a first fastener 48, such as, for example and without being limitative, hook-and-loop fasteners. In these embodiments, the attachment tab 38 also includes a foldable portion 50. The foldable portion 50 includes comprising a plurality of vertically spaced adjustment fasteners 52A,B,C (FIG. 5), such as for example and without being limitative, hook-and-loop fasteners. The foldable portion 50 is configured to be folded towards the base portion 46 after insertion of the attachment tab 38 in the middle portion 44 of the support band 40. The first fastener 48 is engageable with any of the plurality of vertically spaced adjustment fasteners to set a vertical position of the knee sleeve 26 inside the corresponding pant leg 27A or 27B. In the illustrated embodiments, the firefighter may choose between three vertical positions of the knee sleeve inside the corresponding pant leg 27A or 27B. Setting the vertical position of the knee sleeve 26 allows for a better alignment between the knee pad 24 being held on the knee sleeve and the knee of the firefighter. It will be noted that the foldable portion 50 and/or the base portion 46 may include any number of fasteners.

The knee sleeve 26 may be made from a broad variety of material, but generally includes a material that enables the application of a compression, and preferably a mild compression on the firefighter's knee, hence providing good support while allowing a sufficient range of motion of the knee, necessary to the normal activities of the firefighter. In some embodiments, the knee sleeves are each made from a flexible material. The knee sleeve 26 can be made, for example and without being limitative, from an elastic material, such that the knee sleeve 26 provides mobility, support and comfort to the firefighter. In some embodiments, the knee sleeve 26 is stretchable. In some embodiments, the knee sleeve 26 comprises a stretchable band. The stretchable band may comprise a blend of an aramid material and a fire-resistant viscose material. In some embodiments, the knee sleeve 26 includes an innermost surface, and at least a portion of the innermost surface is made of a meta-aramid material. In some embodiments, the portion of the innermost surface being made of a meta-aramid material extends across the front knee portion of corresponding pants leg 27A or 27B.

Referring back to FIGS. 3A-B, the firefighter protective pants may further include, in some embodiments, an abrasion-resistant mesh fabric 54 covering the knee pad 24. In some embodiments, the abrasion-resistant mesh fabric 54 comprises poly-paraphenylene terephthalamide (commercialised under the trademark Kevlar). In some embodiments, the abrasion-resistant mesh fabric 54 comprises a para-aramid material. In some embodiments, the knee pad 24 is permanently attached to the knee sleeve 26. The knee pad 24 can be permanently attached to the knee sleeve 26 with any fasteners, such as one or more seams. In some embodiments, the abrasion-resistant mesh fabric 54 is seamed to knee sleeve 26 and the knee pad 24 is sandwiched between the abrasion-resistant mesh fabric 54 and the knee sleeve 26.

Other embodiments of the firefighter protective pants 20 will now be described.

Figure 7B:
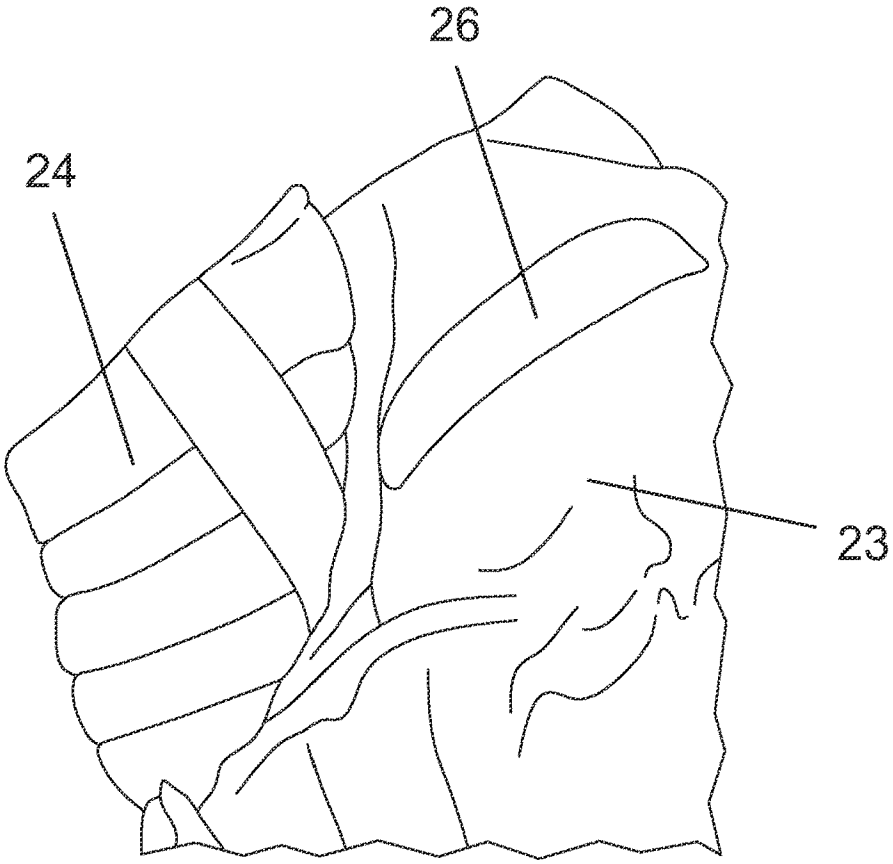
FIGS. 7A-B show an embodiment of a knee support and the knee pad provided in a pant leg.
Figure 7A:
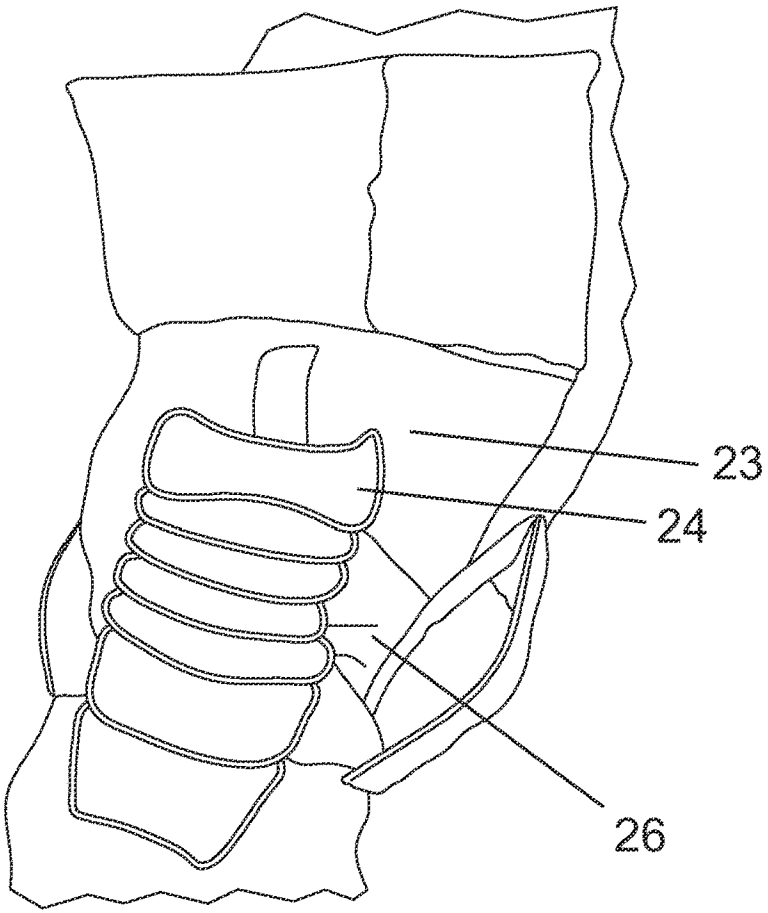

With reference to FIGS. 7A-B, there is shown a knee support 26 in accordance with one embodiment. The knee support 26 is sized, configured and positioned to provide support to the knee pads 24, i.e., to maintain the knee pads 24 at a knee height of the pants legs of the firefighter protective pants 20, such that when the firefighter protective pants 20 are worn by the firefighter, the knee pads 24 extends across a knee portion, preferably a front knee portion and/or lateral knee portions of the firefighter protective pants 20. In the depicted embodiment, the knee support 26 is embodied by a strip of hooks (or loops), while the knee pads 24 are provided with a strip of loops (or hooks). The loops (or hooks) of the knee pads 24 are engageable to the hooks (or loops) of the knee sleeve 26, so that the knee pads 24 can be affixed to the knee sleeve 26. One would note that the knee sleeve 26 according to this embodiment is releasably engageable with the knee pads 24, which could for example and without being limitative facilitate maintenance of the firefighter pants. In other embodiments, the knee pads 24 could further be seamed or attached to the inner liner 23 with appropriate fasteners.

Now turning to FIGS. 8A-D, there is shown another embodiment of the knee pad 24 and the knee sleeve 26. In this embodiment, the knee pad 24 is insertable into the knee sleeve 26. In FIGS. 8A-B, it is shown that the knee sleeve 26 can include a pocket to receive the knee pad 24 therein, such that the knee pads 24 is held by the knee sleeve 26, relatively close to the firefighter's body. The pocket can be closable or sealable to prevent the knee pad 24 from falling from the pocket during the activities of the firefighter. In alternate embodiments, the knee pad 24 could be affixed to the knee sleeve 26 through know fasteners and means.

In the embodiment of FIGS. 8A-D, the knee sleeve 26 may include a meta-aramid material. In some embodiments, the knee sleeve 26 may include a blend of a fire-resistant viscose material, Nomex® (or a similar product, such as, for example and without being limitative, Kermel®) and spandex. For example, and without being limitative, the knee sleeve 26 can include from about 5% to about 10% of spandex, from about 10% to about 15% of Nomex® and from about 75% to about 85% of the fire-resistant viscose material. Of course, one would readily understand that this composition (or ratio) could change. It is however important to note that the material composition of the knee sleeve 26 is typically a trade-off between the fire-resisting (or fire-retarding) properties (provided by the viscose material) and other properties related to the comfort of the firefighter (provided by the spandex). It is to be noted that other material(s) could also be used, as long as their properties enable their integration into the firefighter protective pants 20.

Figure 9A:
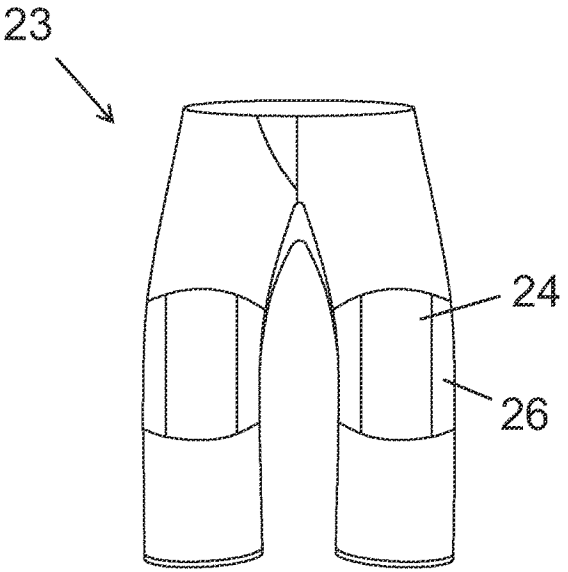
FIGS. 9A-D illustrate different configurations of the knee sleeves affixed to the inner liner of the firefighter protective pants and the knee pads held on the knee sleeves.

FIG. 9A illustrates an embodiment of the knee sleeve 26 affixed to the inner liner 23. In this embodiment, the knee pad 24 is made from foam and the knee sleeve 26 includes hook and loop fasteners to maintain the knee pads 24 in position (i.e., aligned with the knee).

Figure 9B:
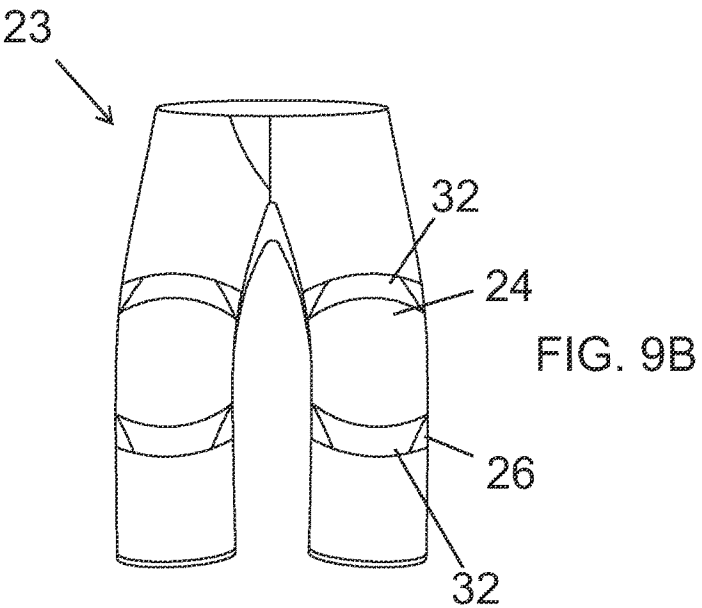
Figure 9C:
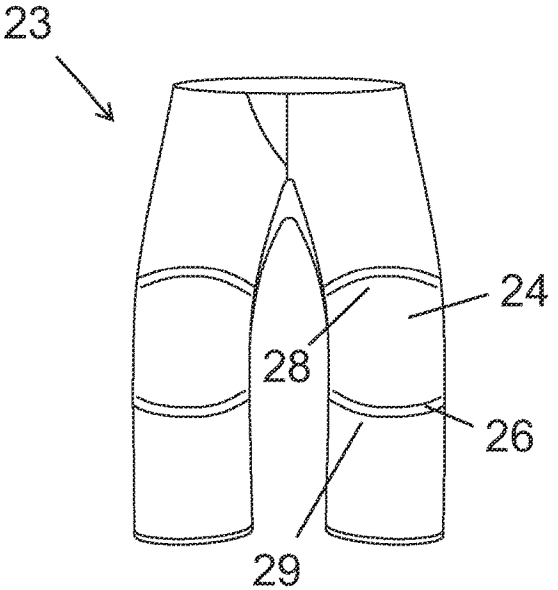
Figure 9D:
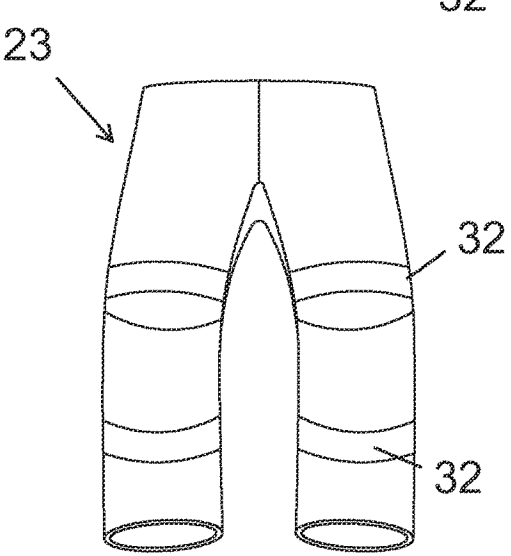

FIG. 9B shows another embodiment of the knee pads 24. In this embodiment, the knee pads 24 is floating, i.e., the knee sleeve 26 is not affixed to the inner liner 23, but is rather maintained aligned with the knee with two elastic bands 32, a first one being provided near or at a top portion of the knee pads 24 and a second one being provided near or at a bottom portion of the knee pads 24. The two elastic bands 32 surround the leg of the firefighter when the pants are worn.

FIGS. 9C-D show the funneled knee sleeve 26. FIG. 9D illustrates a rear view of the firefighter protective pants 20 in order to illustrate that the elastic bands 32 could be, in some embodiments, affixed to the inner liner 23 of the pants.

Figure 10A:
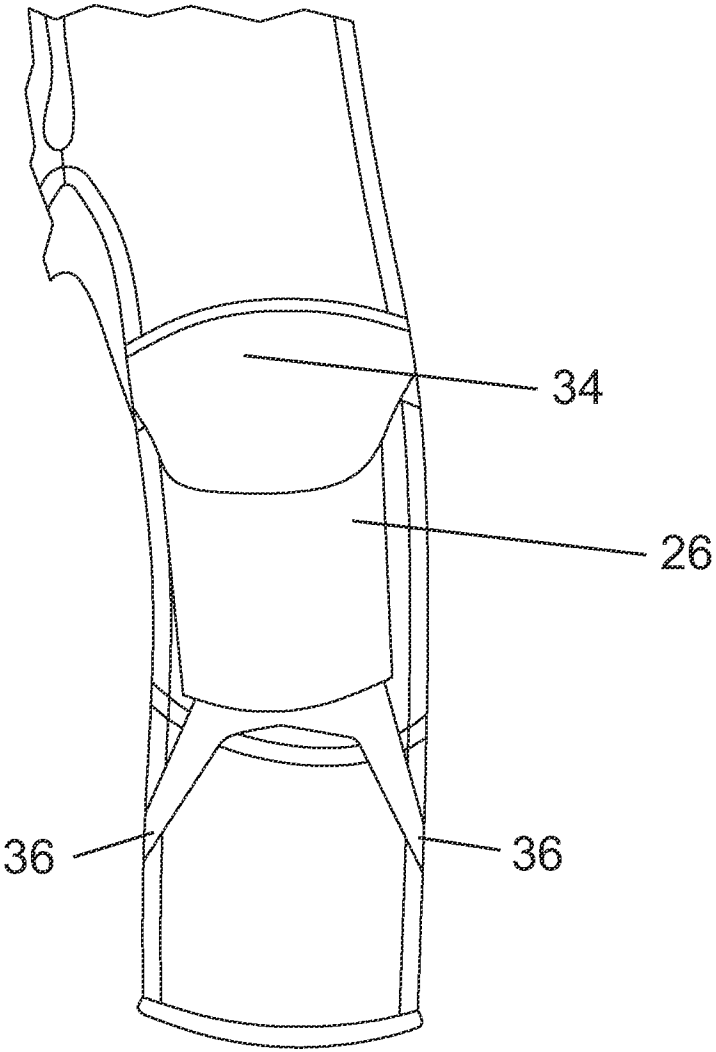
FIGS. 10A-C show the knee sleeve and the knee pad, in accordance with one embodiment, in accordance with one embodiment.
Figure 10C:
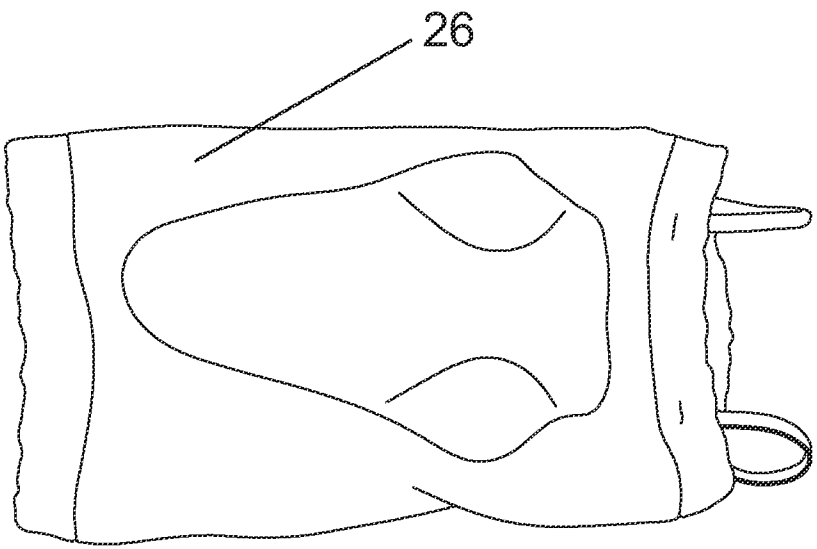
Figure 10B:
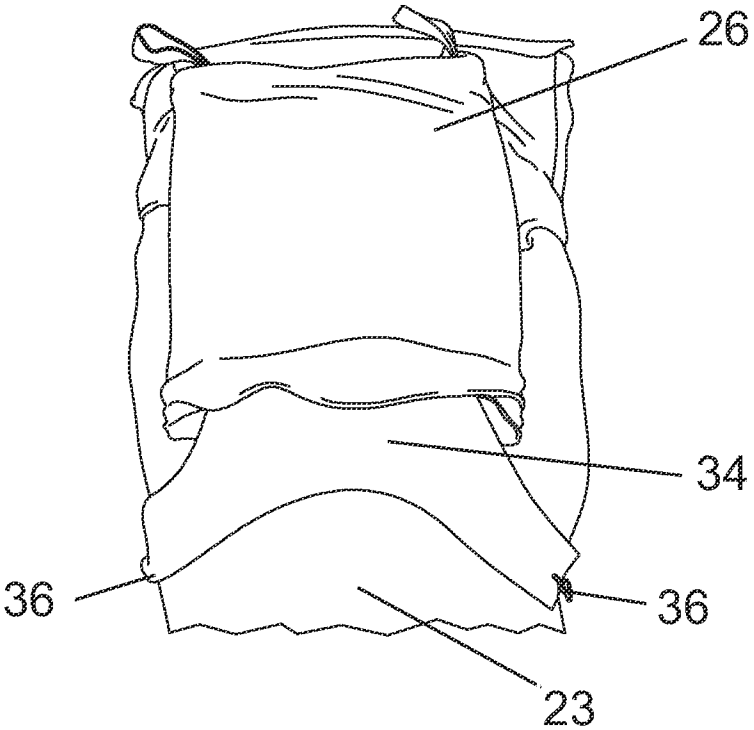

With reference to FIGS. 10A-C, another embodiment of the firefighter protective pants 20 will now be described. In this embodiment, a piece of fabric, which will be referred to a panel 34, can be inserted into the knee sleeve 26. The panel 34 can be affixed in its top portion to the inner liner 23 of the firefighter protective pants 20. The panel 34 can further be affixed in its bottom portion to the inner liner 23 with fasteners 36, such as, for example and without being limitative, buttons or similar mechanical fasteners. The insertion of the panel 34 within the knee sleeve 26 and its attachment to the inner liner 23 may stretch the knee sleeve 26, so as to expand its diameter, which may in turn facilitate quick donning and doffing of the firefighter protective pants 20. More particularly, each leg of the inner liner 23 can include two panels 34, which can be useful, for example and without being limitative, to guide the foot of the firefighter during its insertion or passage through the knee sleeve 26.

In some embodiments, the knee sleeve 26 can be attached with fasteners to the inner liner 23, such that the position of the knee sleeve 26 can be adjusted along the longitudinal axis of the leg of the firefighter (i.e., the height). Such embodiments can be useful to make the knee sleeve 26 more comfortable to use by the firefighter.

Figure 11:
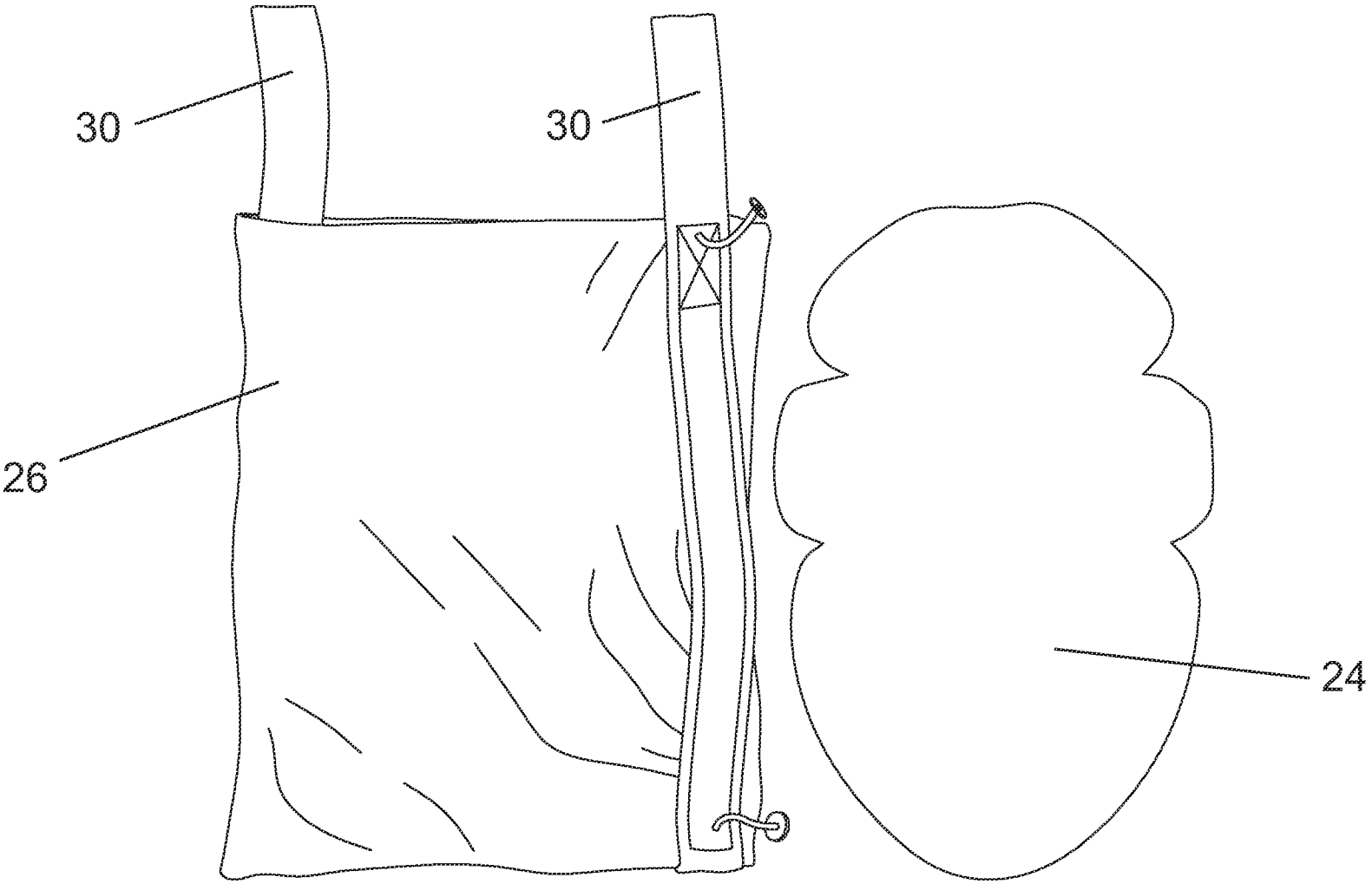
FIG. 11 shows the knee sleeve and the knee pad, in accordance with one embodiment.
Figure 12:
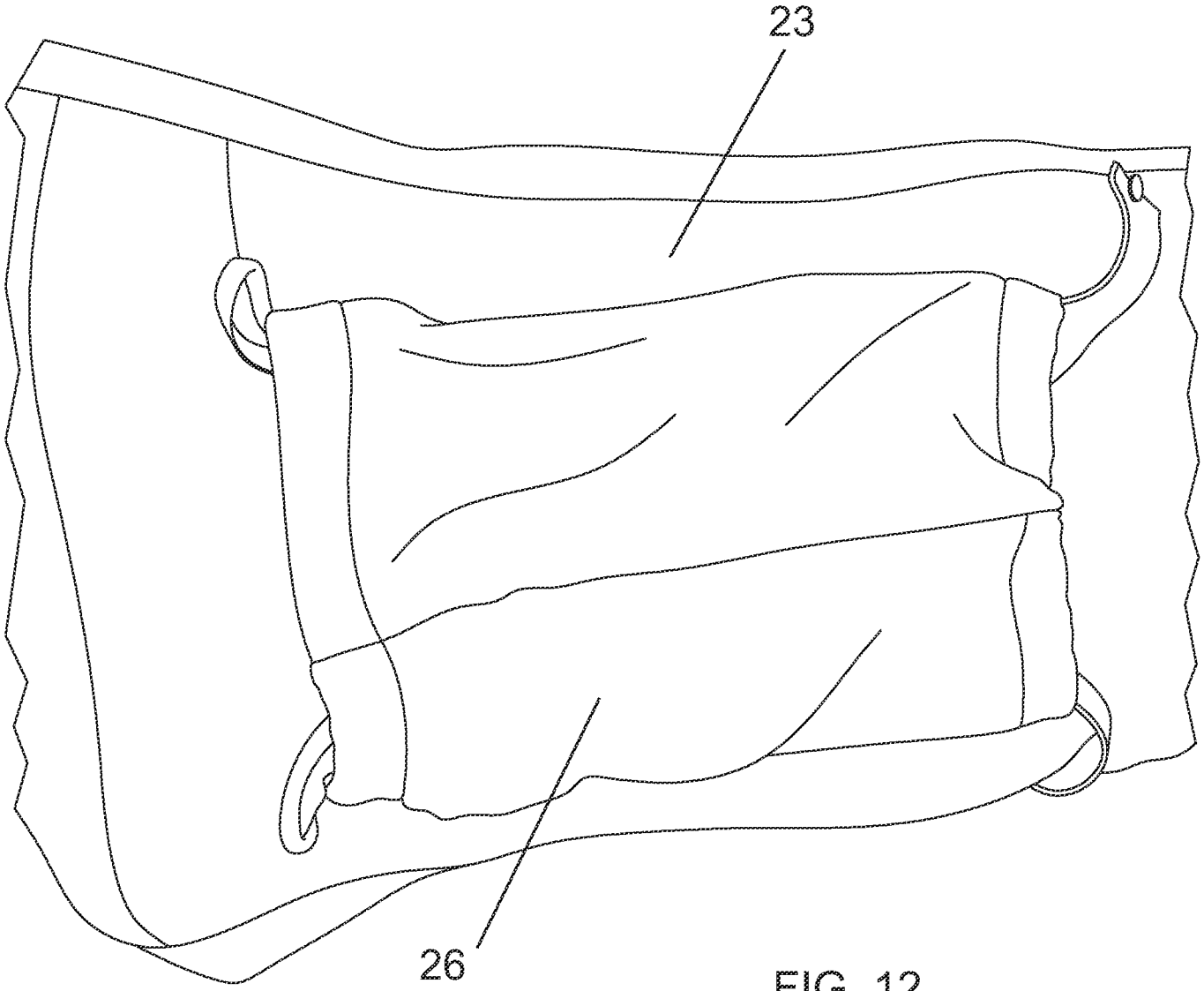
FIG. 12 shows the knee pad inserted in the knee sleeve of FIG. 11.

FIGS. 11 and 12 show two views of a knee sleeve 26 and a knee pad 24. In FIG. 11, it is illustrated that the handles 30 (or tabs) are affixed with seams to the knee sleeve 26, and that the handles 30 extend along the vertical portion of the perimeter of the knee portion on each side. FIG. 12 shows that the knee sleeve 26 can then be affixed to the inner liner 23, as it has been previously described.

Figure 13:
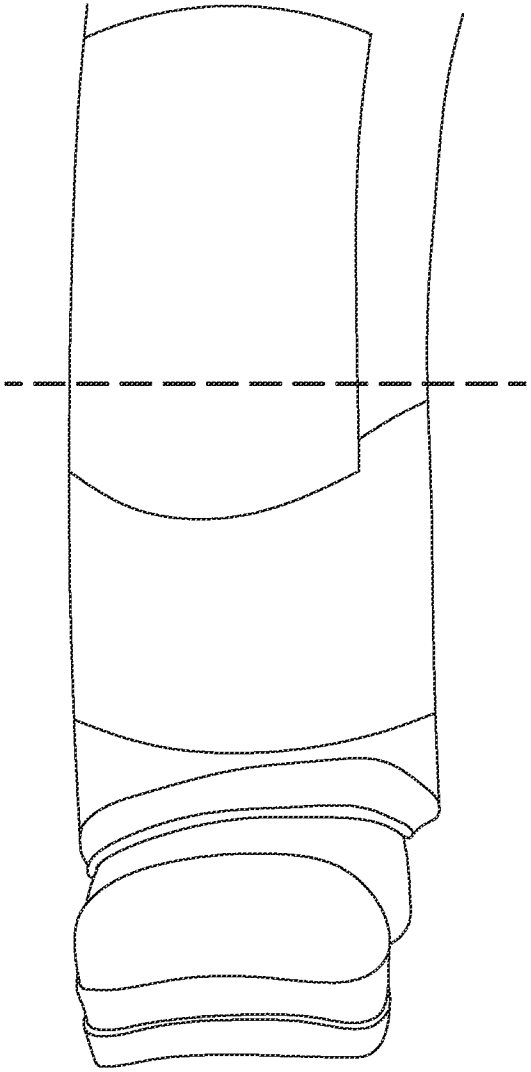
FIG. 13 shows the relative position of the top end portion of the boot shaft with respect to the knee sleeve and the knee pad.
Figure 14:
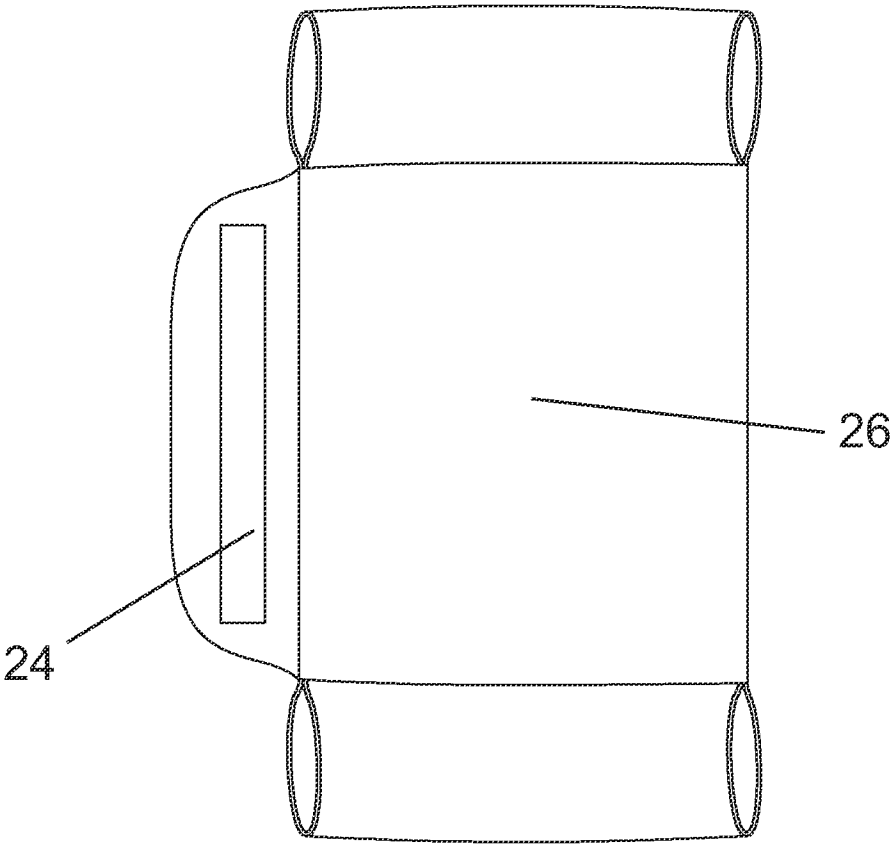
FIG. 14 is a representation of the knee pad inserted into the knee sleeve, in accordance with one embodiment.

FIG. 13 illustrates that the boot shaft (dotted line) can extend substantially high along the longitudinal axis of the firefighter's leg. As such, it is to be noted that the knee pad 24 generally does not extend or only minimally extend below the level defined by the top portion of the boot shaft, so that the knee pads 24 is not inserted into the boot shaft, which would compromise both the comfort of the firefighter and the proper alignment of the knee pads. FIG. 14 is a representation of a knee pads 24 inserted into a knee sleeve 26 that meets this criterion. As it will be noted the dimensions of the knee pad 24 are small enough to prevent its insertion in the boot shaft.

Figure 15:
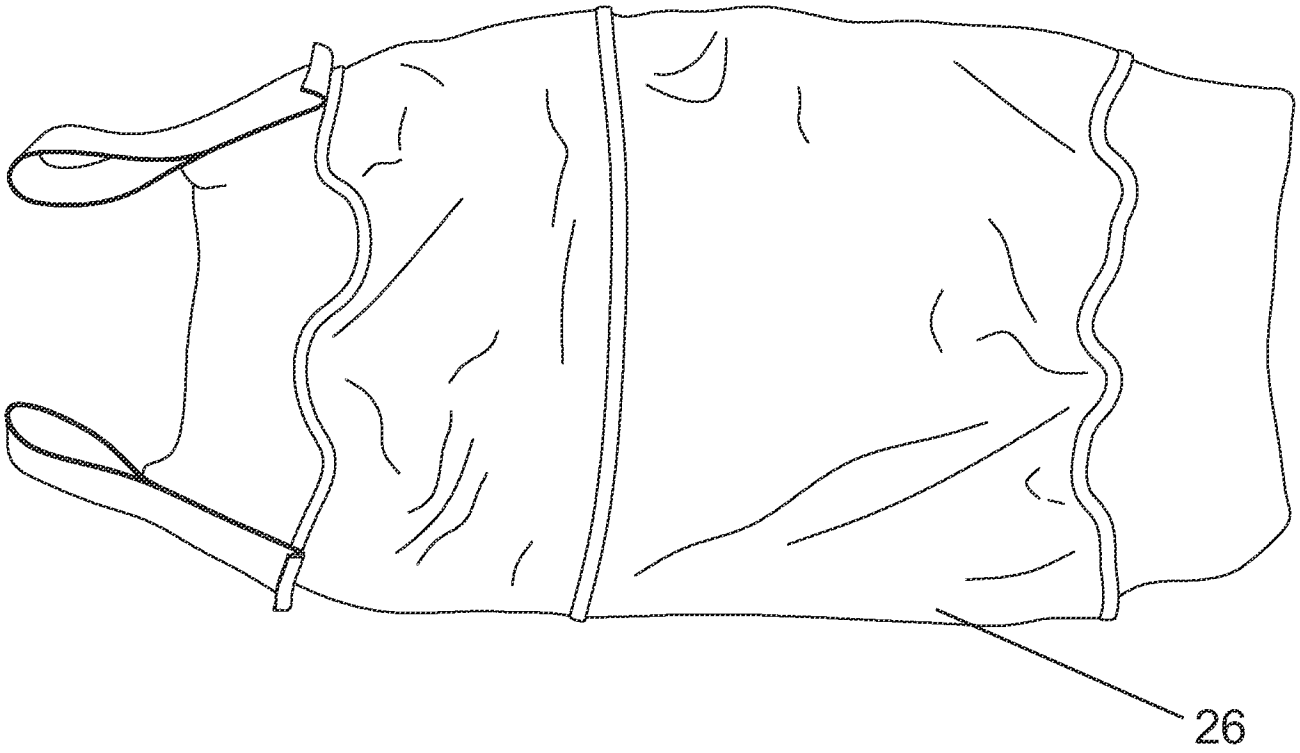
FIG. 15 illustrates an embodiment of the knee sleeve.
Figure 16:
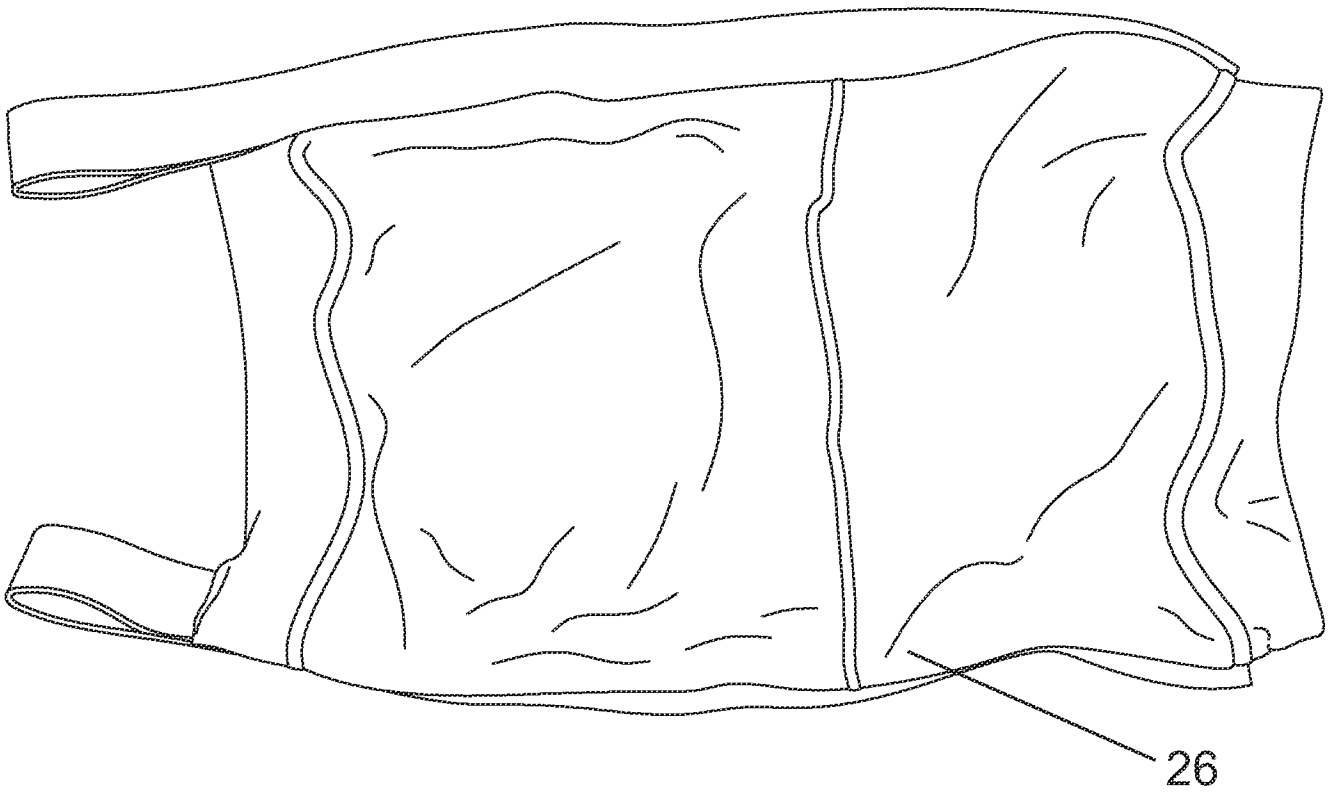
FIG. 16 illustrates an embodiment of the knee sleeve.
Figure 17:
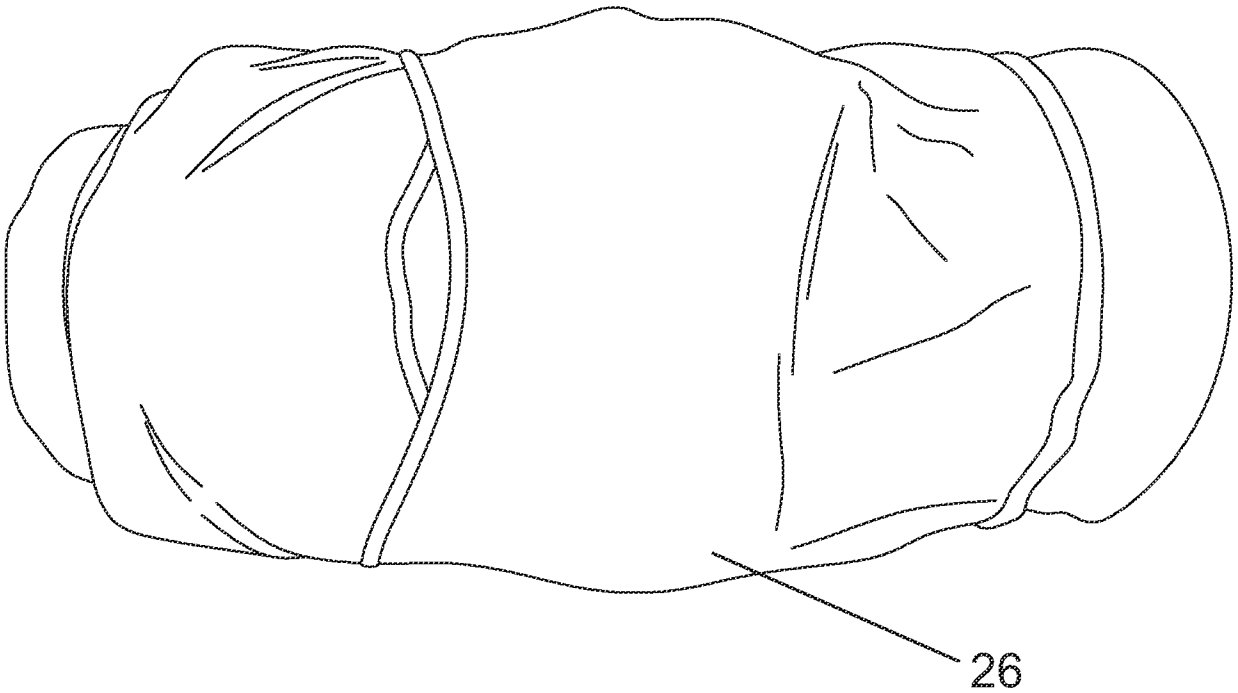
FIG. 17 illustrates an embodiment of the knee sleeve.

FIGS. 15 to 17 illustrate various possible embodiments of the knee sleeve 26. More particularly, the material used to make these embodiments differ one from another. For example, in FIG. 15, the knee sleeve 26 is made from a Nomex® fabric in the knee region, which could be loose on the firefighter's legs. Such an embodiment may be contemplated when the firefighter's legs have a relatively large size. FIG. 16 illustrates a knee sleeve 26 made with a Nomex® fabric in which Spandex has been added. Such an embodiment may provide the firefighter's knee with a better support.

As for the general advantages provided by the embodiments herein described, the firefighter pants 20 according to the description allow, for one, an integration of the knee sleeve 26 and knee pads 24 inside the firefighter pants 20, and more particularly to the inner liner 23, which enables the possibility of a single-step donning of the firefighter protective pants 20. The combination of the knee pads 24 and the knee sleeve 26 provides the firefighter protective pants 20 with complete, close-fitting, flexible and stable knee protection. Of course, one would readily have understood that the firefighter protective pants 20 herein described comply with NFPA 1971.

Several alternative embodiments and examples have been described and illustrated herein. The embodiments described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. The present examples and embodiments, therefore, are to be considered in all respects as illustrative and not restrictive. Accordingly, while specific embodiments have been illustrated and described, numerous modifications come to mind without significantly departing from the current description.

The invention claimed is:

1. Firefighter protective pants, comprising:
an inner liner;
an outer shell made of a flame-resistant material, the outer shell extending over at least a portion of the inner liner; and
two pant legs, each of said two pant legs comprising:
a knee sleeve affixed to the inner liner at a knee height inside a corresponding pant leg; and
a knee pad held on the knee sleeve and extending across at least one of a front knee portion and lateral portions of said corresponding pant leg.

2. The firefighter protective pants of claim 1, wherein the knee pad is made from closed-cell foam.

3. The firefighter protective pants of claim 1, wherein the knee pad comprises perforations therein.

4. The firefighter protective pants of claim 3, wherein each perforation has a diameter of about ⅛ inch.

5. The firefighter protective pants of claim 3, wherein the perforations are evenly distributed across a surface of the knee pad.

6. The firefighter protective pants of claim 1, further comprising an abrasion-resistant mesh fabric covering the knee pad.

7. The firefighter protective pants of claim 6, wherein the abrasion-resistant mesh fabric comprises poly-paraphenylene terephthalamide.

8. The firefighter protective pants of claim 1, wherein the knee sleeve comprises an innermost surface and at least a portion of the innermost surface is made of a meta-aramid material.

9. The firefighter protective pants of claim 8, wherein said at least a portion of the innermost surface extends across the front knee portion of said corresponding pant leg.

10. The firefighter protective pants of claim 1, wherein the knee pad is permanently attached to the knee sleeve.

11. The firefighter protective pants of claim 1, wherein the knee sleeve is stretchable.

12. The firefighter protective pants of claim 1, wherein the knee sleeve comprises a stretchable band.

13. The firefighter protective pants of claim 12, wherein the stretchable band comprises a blend of an aramid material and a fire-resistant viscose material.

14. The firefighter protective pants of claim 1, wherein the knee sleeve is a tubular piece of material.

15. The firefighter protective pants of claim 14, the tubular piece of material being shaped and sized to fit snuggly around the firefighter's knee when the firefighter protective pants are worn by the firefighter.

16. The firefighter protective pants of claim 1, wherein the inner liner is one of a moisture barrier or a thermal barrier.

17. The firefighter protective pants of claim 1, wherein the knee pad has a length of about 10 inches and a width of about 7 inches.

18. Firefighter protective pants, comprising:
an inner liner;
an outer shell made of a flame-resistant material, the outer shell extending over at least a portion of the inner liner; and
two pant legs, each of said two pant legs comprising:
a knee sleeve affixed to the inner liner at a knee height inside a corresponding pant leg; and
a knee pad held on the knee sleeve and extending across at least one of a front knee portion and lateral portions of said corresponding pant leg;
an attachment tab permanently affixed to the knee sleeve; and
a support band having two extremities permanently affixed to the inner liner and a middle portion detached from the inner liner, wherein the middle portion of the support band is configured to receive a segment of the attachment tab therethrough to engage the attachment tab with the support band, thereby affixing the attachment tab to the inner liner.

19. Firefighter protective pants, comprising:
an inner liner;
an outer shell made of a flame-resistant material, the outer shell extending over at least a portion of the inner liner; and
two pant legs, each of said two pant legs comprising:
a knee sleeve affixed to the inner liner at a knee height inside a corresponding pant leg; and
a knee pad held on the knee sleeve and extending across at least one of a front knee portion and lateral portions of said corresponding pant leg;
an attachment tab permanently affixed to the knee sleeve; and
a support band having two extremities permanently affixed to the inner liner and a middle portion detached from the inner liner, wherein the middle portion of the support band is configured to receive a segment of the attachment tab therethrough to engage the attachment tab with the support band, thereby affixing the attachment tab to the inner liner;
wherein the attachment tab comprises:
a base portion, the base portion comprising a first fastener; and
a foldable portion, the foldable portion comprising a plurality of vertically spaced adjustment fasteners, the foldable portion being configured to be folded towards the base portion after insertion of the attachment tab in the middle portion of the support band, wherein the first fastener is engageable with any of the plurality of vertically spaced adjustment fasteners to set a vertical position of the knee sleeve inside the corresponding pant leg.

* * * * *